US007805804B2

(12) United States Patent
Loebig

(10) Patent No.: US 7,805,804 B2
(45) Date of Patent: Oct. 5, 2010

(54) STEERABLE UPRIGHT VACUUM CLEANER

(75) Inventor: Jeffrey C. Loebig, Twinsburg, OH (US)

(73) Assignee: Royal Appliance Mfg. Co., Glenwillow, OH (US)

( * ) Notice: Subject to any disclaimer, the term of this patent is extended or adjusted under 35 U.S.C. 154(b) by 1323 days.

(21) Appl. No.: 11/312,739

(22) Filed: Dec. 20, 2005

(65) Prior Publication Data

US 2006/0207054 A1 Sep. 21, 2006

Related U.S. Application Data

(60) Provisional application No. 60/637,965, filed on Dec. 21, 2004.

(51) Int. Cl.
*A47L 9/00* (2006.01)

(52) U.S. Cl. ..... 15/351; 15/411

(58) Field of Classification Search ..... 15/350, 15/351, 411; *A47L 9/00*
See application file for complete search history.

(56) References Cited

U.S. PATENT DOCUMENTS

| | | | |
|---|---|---|---|
| 1,139,736 | A | 5/1915 | Stabel |
| 2,038,697 | A | 4/1936 | Winslow |
| 2,162,313 | A | 6/1939 | McCabe et al. |
| 3,581,591 | A | 6/1971 | Ziegler et al. |
| 5,075,921 | A | 12/1991 | Gleadall |
| 5,323,510 | A | 6/1994 | Redding et al. |
| 5,381,577 | A | 1/1995 | Lilja |
| 5,584,095 | A | 12/1996 | Redding et al. |
| 5,794,305 | A | 8/1998 | Weger |
| 6,055,703 | A | 5/2000 | Redding et al. |
| 2005/0223516 | A1 | 10/2005 | Courtney |
| 2005/0223517 | A1 | 10/2005 | Courtney |
| 2005/0235454 | A1 | 10/2005 | Courtney |

FOREIGN PATENT DOCUMENTS

| | | |
|---|---|---|
| EP | 0 909 546 A2 | 4/1999 |
| JP | 2234733 | 9/1990 |
| JP | H2-237523 | 9/1990 |
| JP | H5-15898 | 4/1993 |
| WO | WO 2004/014209 A1 | 2/2004 |
| WO | WO 2004/014210 A1 | 2/2004 |
| WO | WO 2004/014211 A1 | 2/2004 |
| WO | WO 2004/069021 A1 | 8/2004 |
| WO | WO 2006/077382 | 7/2006 |

OTHER PUBLICATIONS

Partial International Search Report dated May 22, 2005.
International Search Report dated Aug. 8, 2006.

*Primary Examiner*—David A Redding
(74) *Attorney, Agent, or Firm*—Michael Best & Friedrich LLP

(57) ABSTRACT

A steerable upright vacuum cleaner includes an upright section including a dirt collecting portion, a collar on which the upright section is mounted and base section to which the collar is attached. The upright section is mounted on the collar such that the upright section pivots around a first axis with respect to the collar. The base section is attached to the collar such that the collar pivots around a second axis with respect to the base section. The second axis is approximately perpendicular to the first axis. The base section includes a nozzle that communicates with the dirt collecting portion.

16 Claims, 4 Drawing Sheets

STEERABLE UPRIGHT VACUUM CLEANER

This application claims the benefit of provisional patent application Ser. No. 60/637,965, filed Dec. 21, 2004.

BACKGROUND OF THE INVENTION

An upright vacuum cleaner typically includes an upright section attached to a lower nozzle section. Wheels are attached to the nozzle section which is pushed across a floor to be cleaned. Typically the upright section pivots only in relation to the nozzle section around an axis that is parallel to an axis in which the wheels rotate. The pivoting capability of the vacuum cleaner allows the user to move the upright section from a generally vertical orientation when the vacuum cleaner is not in use to a more comfortable angled configuration, with reference to the floor, to push and pull the nozzle section across the floor.

A need has been recognized to provide vacuum cleaners that include additional maneuverability features. Some steerable vacuum cleaners are known; however, a need still exists for a steerable upright vacuum cleaner that is both easy for a user to maneuver and simpler to manufacture than known steerable vacuum cleaners.

SUMMARY OF THE INVENTION

A steerable upright vacuum cleaner includes an upright section including a dirt collecting portion, a collar on which the upright section is mounted and base section to which the collar is attached. The upright section is mounted on the collar such that the upright section pivots around a first axis with respect to the collar. The base section is attached to the collar such that the collar pivots around a second axis with respect to the base section. The second axis is approximately perpendicular to the first axis. The base section includes a nozzle that communicates with the dirt collecting portion.

In another embodiment, a steerable upright vacuum cleaner includes a nozzle section, a connector, an upright section, a dirt collection portion, a suction source and a conduit. The nozzle section includes a dirty air inlet. The connector mounts to the nozzle section such that the connector pivots around a first axis with respect to the nozzle section. The upright section mounts to the connector such that the upright section pivots around a second axis with respect to the connector. The upright section includes a longitudinal axis that is approximately perpendicular to both the first axis and the second axis. The dirt collection portion is mounted to the upright section. The suction source is disposed in either the nozzle section or the upright section and communicates with the dirt collection chamber. The conduit communicates with the dirty air inlet of the nozzle section and the dirt collection chamber.

In another embodiment, a steerable upright vacuum cleaner includes a nozzle section, an upright section, a connector, a dirt collection portion and a suction source. The nozzle section includes a dirty air inlet. The upright section defines a longitudinal axis. The connector attaches the upright section to the nozzle section. The connector allows the upright section to pivot around a first axis such that a distal end of the upright section moves closer to and farther from an associated surface to be cleaned by the vacuum cleaner. The connector also allows the upright section to pivot around a second axis that is approximately perpendicular to the first axis. The dirt collection portion is associated with the upright section and communicates with the dirty air inlet. The suction source is mounted to the nozzle section or the upright section and communicates with the dirt collection chamber for drawing air toward the dirt collection chamber.

DETAILED DESCRIPTION

Figure 3:
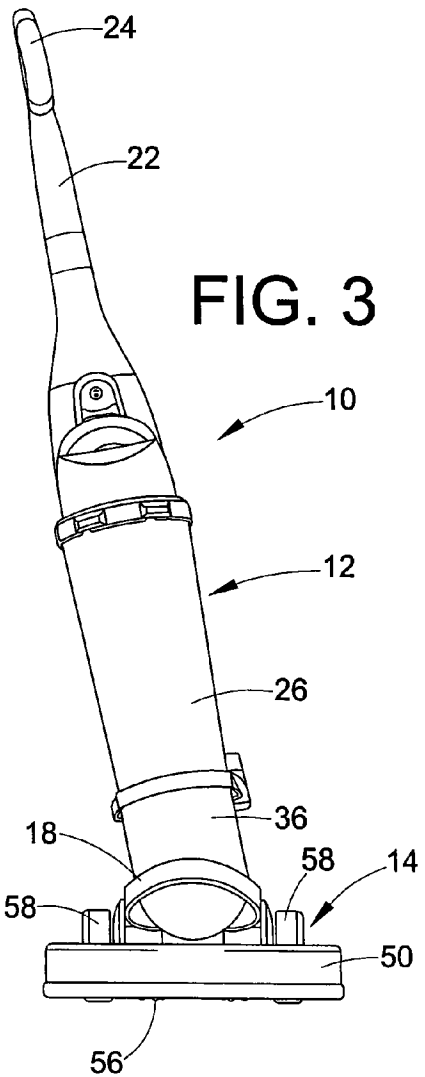
FIG. 3 is a front elevation view of the vacuum cleaner of FIG. 1.
Figure 2:
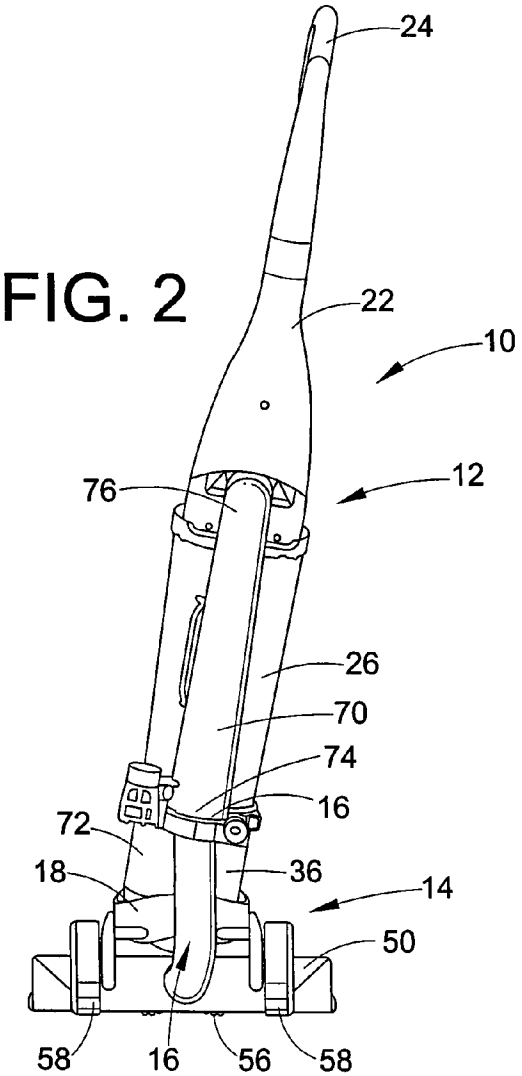
FIG. 2 is a rear elevation view of the vacuum cleaner of FIG. 1.
Figure 1:
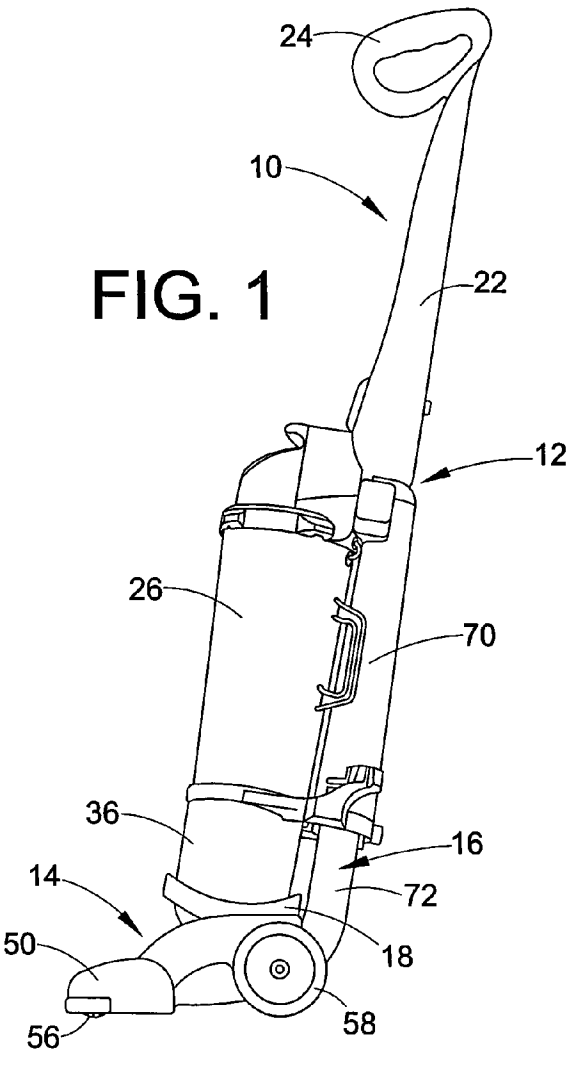
FIG. 1 is a side elevational view of a steerable upright vacuum cleaner.

With reference to the FIGS. 1-3, a steerable upright vacuum cleaner 10 according to an embodiment of the present invention generally includes an upright section 12, a base or nozzle section 14, a conduit 16 for providing fluid communication between the nozzle section and the upright section, and a connector 18 for attaching the upright section to the base. As a result of the structure of the connector 18, as well as the base 14 and the upright section 12, the upright section 12 can move around at least two axes in relation to the base 14 so that the upright vacuum cleaner 10 is easily maneuverable.

Figure 7:
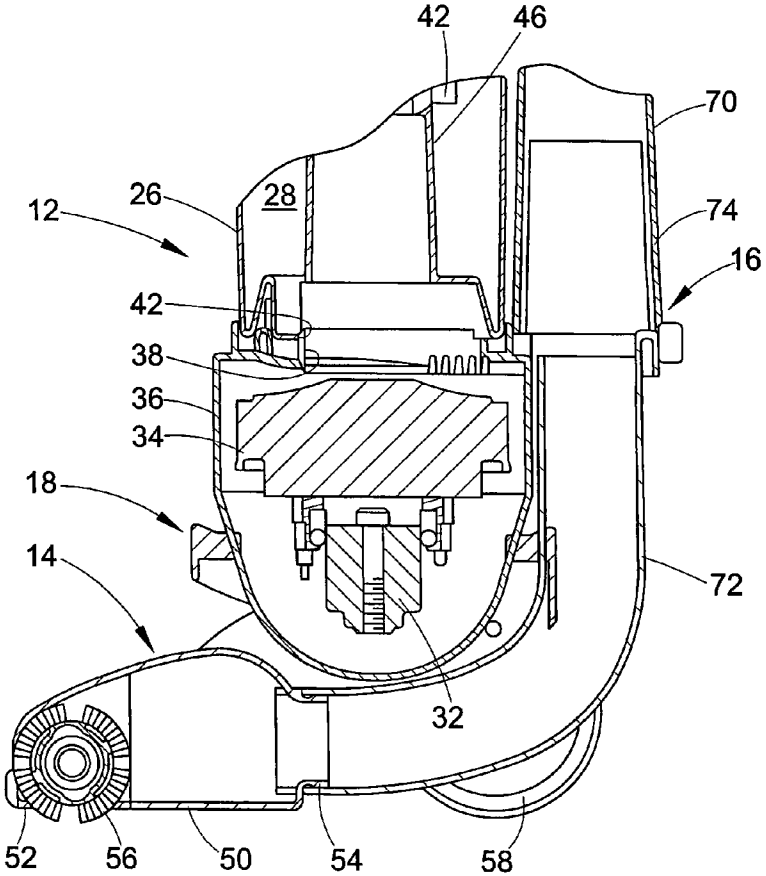
FIG. 7 is a cross-sectional view taken along line 7-7 of FIG. 6.
Figure 6:
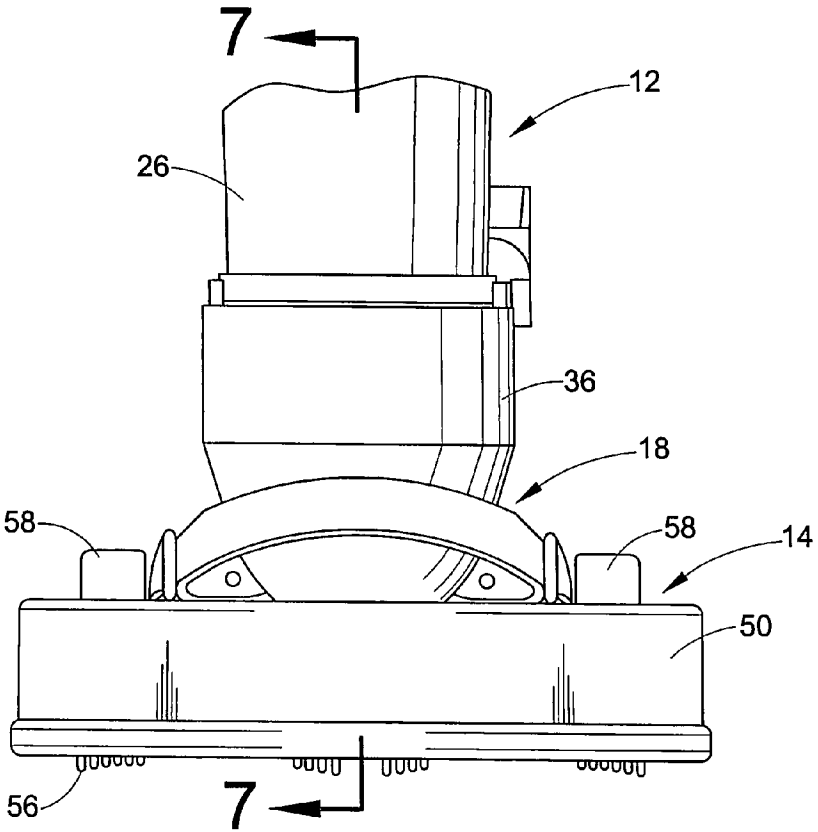
FIG. 6 is an enlarged front elevation view of the lower portion of the vacuum cleaner of FIG. 1.
Figure 9:
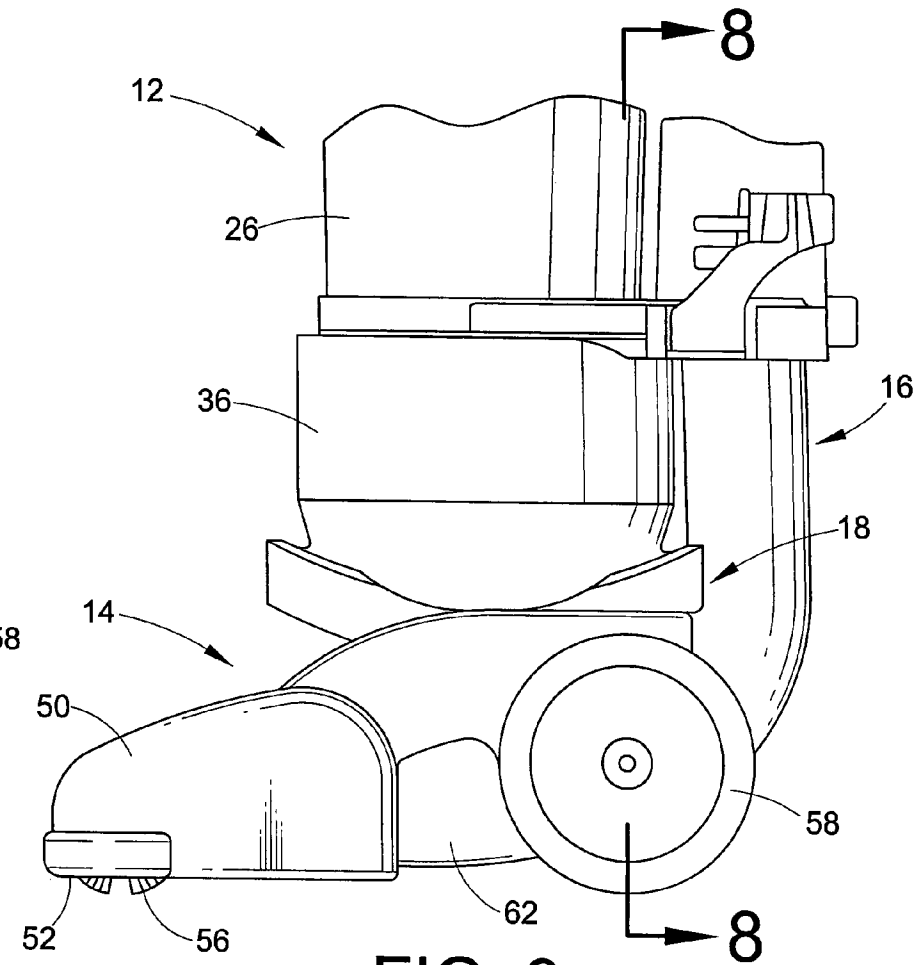
FIG. 9 is an enlarged side elevational view of the lower portion of the vacuum cleaner of FIG. 1.
Figure 8:
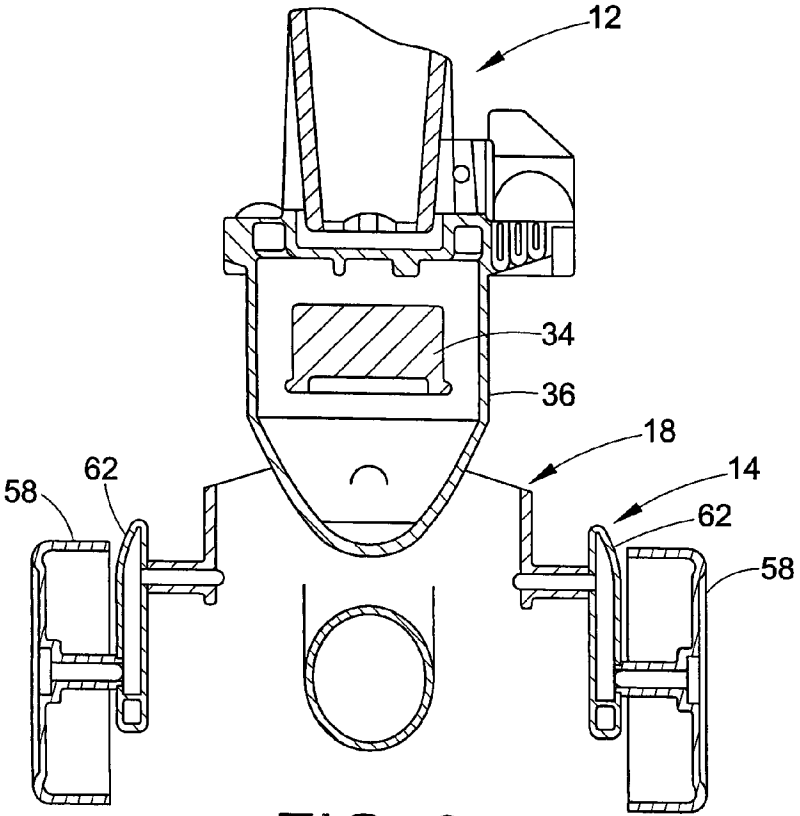
FIG. 8 is a cross-sectional view taken along line 8-8 of FIG. 9.

The upright section 12 includes a handle 22 and a hand grip 24 located at an end of the upright section opposite the base 14. The upright section also includes a canister or dirt cup 26 that defines a dirt collecting chamber 28 (FIG. 7). If desired, the canister 26 can be a cylindrical plastic piece in which dirt and debris can be deposited. However, the canister can take other forms or could be replaced with a filter bag, which is well known in the art. Thus, any known dirt collecting construction, portion or member could be used.

A motor and fan assembly provides a suction source for the vacuum cleaner 10 depicted in the figures. With reference to FIG. 7, a motor 32 drives a fan 34, both of which are disposed in a motor/fan assembly housing 36 disposed below the canister 26. The housing 36 defines an opening 38 that communicates with an opening 42 in a base wall of the canister 26. Air can be drawn from the dirt collecting chamber 28 defined in the canister 26, toward the fan 34 to provide a suction source for the vacuum cleaner. A filter 44 can be disposed in the canister 26, supported by a filter stand 46. Air flow can be directed through the filter 44 towards the fan 34.

Figure 5:
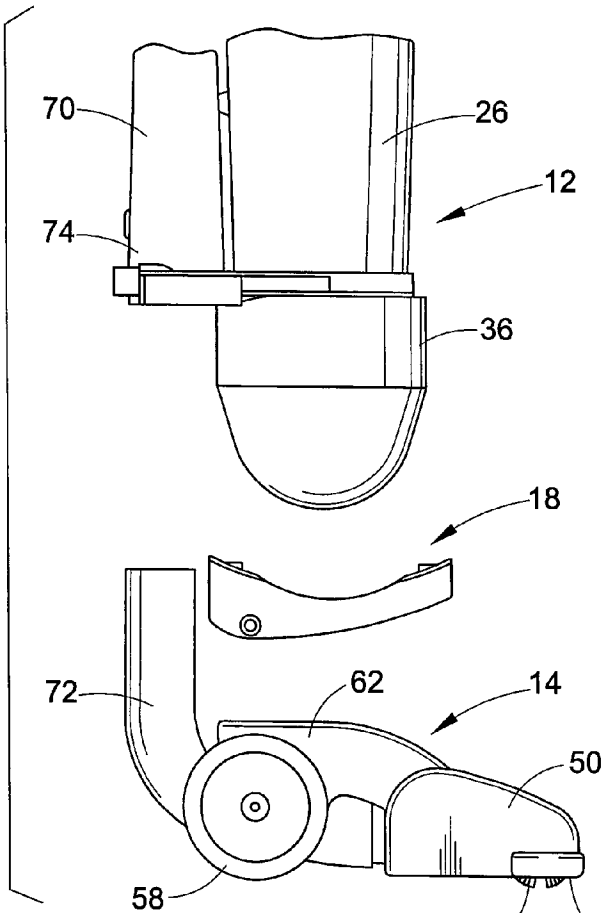
FIG. 5 is an enlarged exploded side elevation view of the lower portion of the vacuum cleaner of FIG. 1.

With reference now to FIG. 5, the nozzle or base section 14 traverses across a surface to be cleaned by the vacuum cleaner 10. The base section 14 includes a nozzle housing 50 that defines both a dirty air inlet 52 and a dirty air outlet 54 (FIG. 7). A brush roll 56 can be disposed in the nozzle housing 54 adjacent the dirty air inlet 52. The brush roll 56 can be powered by a brush roll motor (not shown) that is known to those skilled in the art. Alternatively, the brush roll 56 can be driven via a turbine assembly arrangement whereby the suction source provides the force to drive the brush roll. This arrangement is also known in the art.

Figure 4:
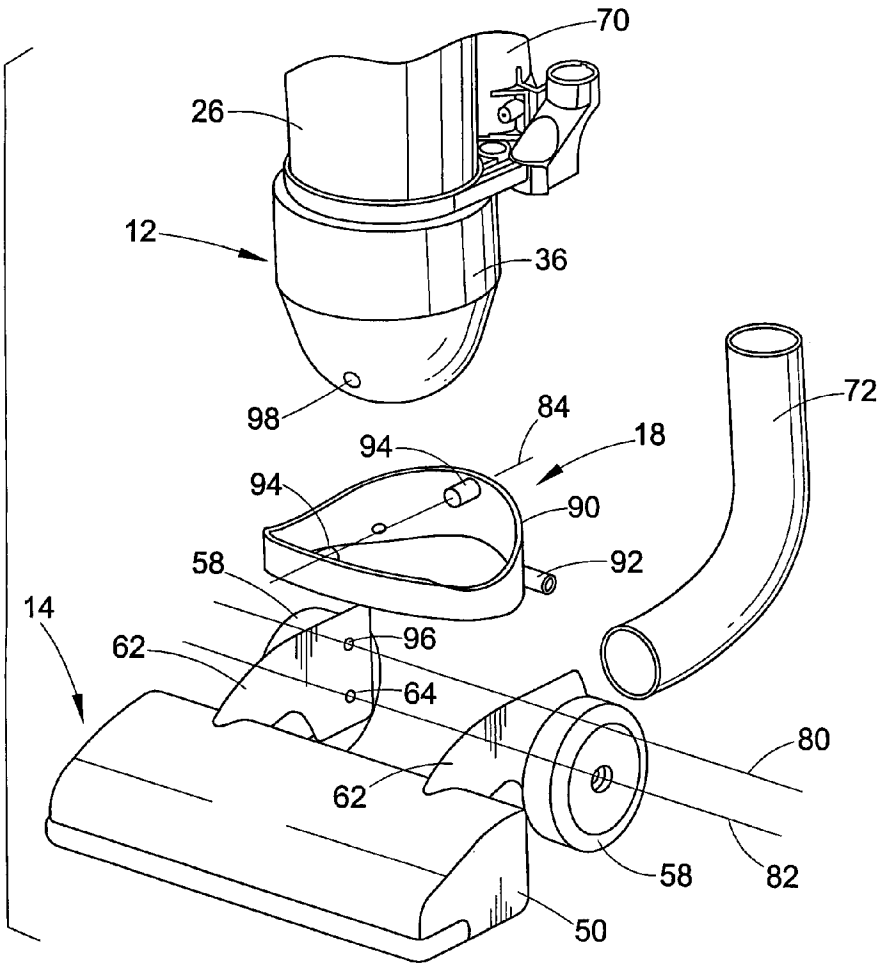
FIG. 4 is an enlarged exploded perspective view of a lower portion of the vacuum cleaner of FIG. 1.

With reference now to FIG. 4, wheels 58 are attached to the nozzle housing 56 to facilitate moving the vacuum cleaner 10 across the floor to be cleaned. In the embodiment depicted in the figures, the wheels 56 simply attach to the nozzle housing 50 such that to propel the vacuum cleaner a person must provide the force. Self-propelled vacuum cleaners are also known and the connector 18 used to attach the upright section 12 to the base 14 can also be used with a self-propelled upright vacuum cleaner. In the depicted embodiment, the wheels 58 are attached to flanges 62 that are located adjacent opposed sides of the nozzle housing 50 and extend rearwardly therefrom. Each flange 62 includes an axle opening 64 (only one visible in FIG. 4) that receive conventional axles to attach the wheel 58 to the flange 62. Of course, it should be appreciated that conventional casters (not shown) could be employed instead of wheels, or in addition thereto: the use of such casters is known in the vacuum cleaner field.

With reference back to FIG. 1, The conduit 16 allows for fluid communication between the base 14 and the upright section 12. In the depicted embodiment, the conduit 16 includes an upper tube or hose 70 that is affixed to the canister 26 and a lower tube or hose 72 that is connected at a lower end to the nozzle housing 50 and at an upper end to the upper tube 70. The lower hose 72 fits into the dirty air outlet 54 in the nozzle housing 50. The lower hose 72 is made from a conventional flexible material to accommodate movement of the upright section 12 in relation to the base 14 so that the lower hose 72 does not disconnect from the nozzle housing 50 or the upper tube 70.

As most clearly seen in FIG. 7, the upper tube 70 can include a tapered lower end 74 that receives the lower hose 72. An upper end 76 (FIG. 2) of the upper tube communicates with the dirt collecting chamber 28. Accordingly, air is drawn into the dirty air inlet 52 through the nozzle housing 50 and out the dirty air outlet 54. Air then travels through the lower hose 72 into the upper tube 70 and toward the dirt collecting chamber 28. Subsequently, dirt entrained in the air can be separated from the air, such as by cyclonic flow or the like in the dirt collecting chamber 28. This is well known in the art. Air then flows through the filter 44, through the opening 42 in the canister 26 and through the opening 38 in the motor housing 36 towards the fan 34. Finally, the air can be ejected through a known filtered air outlet (not shown).

The connector 18 attaches the upright section 12 to the base 14. With reference again to FIG. 4, the connector 18 can pivot in relation to the base 14 about or around a first axis 80 that is parallel to both an axis 82 around which the wheels 58 rotate and the floor or other surface to be cleaned. The connector 18 also allows the upright section 12 to pivot around a second axis 84 that is perpendicular to the first axis 80. Accordingly, the upright housing 12 can pivot in relation to the base 14 around two axes. Such axes can be approximately perpendicular to one another, if desired. When the upright section 12 is in a storage position, i.e., substantially vertical, both the first axis 80 and the second axis 84 can lie in parallel approximately horizontal planes, and can also lie in approximately perpendicular vertical planes.

In the embodiment depicted, the connector 18 includes a substantially toroidal collar 90 having a pair of first connection members 92 that align with the first axis 80 when the collar 90 is attached to the base section 14 and a second set of connecting members 94 aligned along the second axis 84. While the connector 18 is termed a collar, it should be recognized that the term "collar" applies to any form of a link structure used to guide the movement of the upper housing 12 in relation to the base 14. The collar 90 can be made from a rigid plastic or other material and have a band-like configuration. The first connecting members 92 can be cylindrical bosses that can receive conventional fasteners (not shown). The collar 90 is interposed between the two spaced apart flanges 62 such that the first connecting members 92 align with two openings 96 (only one visible) that are spaced above the axle openings 64 in the flanges 62. Fasteners are received in the cylindrical bosses 92 through the openings 96 to attach the collar 90 to the flanges 62. The fasteners allow for rotation of the connector 18 around the first axis 80 so that the connector can pivot in relation to the base section 14. Alternatively, connection between the collar 90 and the base section 14 can be made in any conventional manner that allows the collar to pivot in the first axis 80.

With continued reference to FIG. 4, the upright section 12 includes openings 98 that receive the second connecting members 94 to attach the upright section 12 to the connector 18. Accordingly, the upright section 12 is received inside the collar and can pivot around the second axis 84 in relation to the connector 18. Connection between the upright section 12 and the collar 90 can also be made in any conventional manner that allows the upright section to pivot around the second axis 84.

Even though specific types of connections between the connector 18 and the upright section 12 and between the connector 18 and the base 14 are described, it is contemplated that the base and the upright section can be mounted to the connector in other conventional ways. For example, known fasteners can be used to attach the connector 18 to the upright section 12, in lieu of the cylindrical posts 94. Likewise, the bosses 92 could be received inside the openings 96 of the flange 62 to attach the connector 18 to the base 14. The components can be mounted to one another in other conventional or known manners that allow the upright section 12 to pivot in relation to the base 14 around at least two axes that can be approximately perpendicular to one another.

Also, the connector can take different configurations than the collar described. For example, the collar does not need to have a continuous ring-like configuration. Instead, the collar can be segmented, having gaps in its periphery. Likewise, the connector need not take a collar-like configuration. The connector can include any type of known link or other joining member that allows the upright section 12 to pivot in relation to the base 14 around at least two axes that can be approximately perpendicular to one another A steerable vacuum cleaner has been described with reference to an embodiment and some alternatives have been described along with the embodiment. Many other alternatives and alterations will occur to those skilled in the art upon reading the preceding detailed description. The preceding detailed description was simply provided to enable one skilled in the art to make and use the invention and to disclose the best mode contemplated by the inventor(s). The preceding description is not meant to limit the invention to only those embodiments described above. For example a connection can be made between the connector 18 and the base section 14 along the second axis 84 and a connection can be made between the upright section 12 and the connector 18 and the upright section in an axis parallel to or aligned with the first axis 80. Instead, the invention is to be broadly construed as defined by the appended claims and the equivalents thereof.

The invention claimed is:

1. An upright vacuum cleaner comprising:

an upright section including a dirt collecting portion;

a collar to which the upright section is mounted such that the upright section pivots around a first axis with respect to the collar;

a base section to which the collar is attached such that the collar pivots around a second axis with respect the base section, wherein said second axis is approximately perpendicular to said first axis, the base section including a nozzle, said nozzle communicating with said dirt collecting portion wherein the collar includes first and second connection members spaced from one another along the first axis and connected to the base section and third and fourth connection members spaced from one another along the second axis and connected to the base section; and a motor/fan assembly mounted to one of said upright section and said base section, said motor/fan assembly communicating with said dirt collecting portion.

2. The upright vacuum cleaner of claim 1, wherein the collar comprises a substantially rigid band having a central opening that receives a lower end of the upright section.

3. The upright vacuum cleaner of claim 1, wherein the first and second connection members are received in corresponding openings in the upright section.

4. The upright vacuum cleaner of claim 1, wherein the third and fourth connection members each include an opening to receive a respective fastener to attach the collar to the base section.

5. An upright vacuum cleaner comprising:

a nozzle section having a dirty air inlet;

a connector mounted to the nozzle section such that the connector pivots around a first axis with respect to the nozzle section;

an upright section mounted to the connector such that the upright section pivots around a second axis with respect to the connector, the upright section including a longitudinal axis that is approximately perpendicular to both the first axis and the second axis wherein the connector comprises a substantially rigid band having a central opening that receives and at least partially surrounds a lower portion of the upright section;

a dirt collection portion mounted to the upright section;

a suction source, disposed in one of the nozzle section and the upright section and in communication with the dirt collection portion; and a conduit in communication with the dirty air inlet of the nozzle section and the dirt collection portion.

6. The upright vacuum cleaner of claim 5, wherein the first axis lies in an approximately horizontal plane when the upright section is in a storage portion.

7. The upright vacuum cleaner of claim 6, wherein the second axis lies in the approximately horizontal plane when the upright section is in a storage position.

8. The upright vacuum cleaner of claim 7, wherein the first axis is spaced above the second axis.

9. The upright vacuum cleaner of claim 5, further comprising wheels connected to the nozzle section, wherein the wheels rotate around a third axis that is approximately parallel to the second axis.

10. The upright vacuum cleaner of claim 5, wherein the conduit is flexible.

11. The upright vacuum cleaner of claim 5, wherein the conduit is connected to a lower portion of the upper section and to the nozzle section.

12. The upright vacuum cleaner of claim 5, further comprising a second conduit section connected to the conduit, the second conduit section including a tapered end that receives an end of the conduit.

13. The upright vacuum cleaner of claim 5, wherein connector includes two posts that are received in respective openings in the upright section.

14. The upright vacuum cleaner of claim 13, wherein the connector comprises two additional posts that are received in respective openings in the nozzle section.

15. The upright vacuum cleaner of claim 14, wherein the two additional posts lie along the second axis.

16. The upright vacuum cleaner of claim 13, wherein the two posts lie along the first axis.

* * * * *